US011054213B2

(12) United States Patent
Schaub

(10) Patent No.: US 11,054,213 B2
(45) Date of Patent: Jul. 6, 2021

(54) ADJUSTABLE SLING FOR RIFLE OR CROSSBOW

(71) Applicant: Alan Schaub, Suttons Bay, MI (US)

(72) Inventor: Alan Schaub, Suttons Bay, MI (US)

( * ) Notice: Subject to any disclaimer, the term of this patent is extended or adjusted under 35 U.S.C. 154(b) by 0 days.

(21) Appl. No.: 16/879,080

(22) Filed: May 20, 2020

(65) Prior Publication Data

US 2021/0025668 A1 Jan. 28, 2021

Related U.S. Application Data

(60) Provisional application No. 62/876,971, filed on Jul. 22, 2019.

(51) Int. Cl.
*F41C 23/02* (2006.01)
*F41C 33/00* (2006.01)

(52) U.S. Cl.
CPC ..... *F41C 23/02* (2013.01); *F41C 33/002* (2013.01)

(58) Field of Classification Search
CPC .. Y10S 224/913; F41C 33/005; F41C 33/003; F41C 33/046
USPC ..... 224/150
See application file for complete search history.

(56) References Cited

U.S. PATENT DOCUMENTS 2,884,172 A * 4/1959 Kubo ..... F41C 23/02 224/149
3,211,351 A 10/1965 Somple
3,869,074 A * 3/1975 Roach ..... F41C 33/005 224/149
4,121,743 A 10/1978 Burton
4,768,689 A 9/1988 Davis
4,964,553 A * 10/1990 Glynn ..... F41C 33/003 224/149
5,092,505 A * 3/1992 Olschlager ..... F41C 23/02 224/149
5,246,154 A 9/1993 Adams et al.
5,383,587 A * 1/1995 Carpenter ..... A63C 11/02 224/200
5,400,937 A * 3/1995 Rottenberg ..... A63C 11/025 224/257
5,564,610 A 10/1996 Barron
5,664,721 A * 9/1997 Homeyer ..... F41C 33/005 224/651
5,927,574 A * 7/1999 Ruesink ..... F41C 33/003 224/149
6,152,338 A * 11/2000 Smith ..... A01K 97/10 224/149
6,749,099 B2 6/2004 Danielson
7,959,046 B2 6/2011 Burnsed, Jr. et al.
D728,924 S * 5/2015 Salisbury, III ..... D3/222
9,194,655 B1 * 11/2015 Cha ..... F41C 33/0236
10,281,234 B1 5/2019 Burnsed, Jr.
(Continued)

*Primary Examiner* — Corey N Skurdal
(74) *Attorney, Agent, or Firm* — Dinsmore & Shohl LLP

(57) ABSTRACT

A chest support sling for hands free transport with quick release of an elongated firearm or crossbow. In each instance, the sling includes a main strap adapted to being supported upon a shoulder of a wearer. The strap is connected at opposite ends to a pocket which is further adapted to be arranged to a side waist location of the wearer and to receive a butt end of the firearm or crossbow. A secondary support strap extends from the main strap and is adapted for engaging an extended location of the firearm or crossbow to maintain hands-free support when carried by the wearer.

14 Claims, 12 Drawing Sheets

(56) References Cited

U.S. PATENT DOCUMENTS

| | | | | |
|---|---|---|---|---|
| 2006/0011677 | A1 | 1/2006 | Burnsed et al. | |
| 2007/0023467 | A1* | 2/2007 | Spreer | F41C 33/046 224/149 |
| 2009/0321484 | A1 | 12/2009 | Schweikert | |
| 2011/0042427 | A1* | 2/2011 | Goransson-Sonnefelt | F41C 33/005 224/149 |
| 2017/0102207 | A1 | 4/2017 | Janzen | |

* cited by examiner

ADJUSTABLE SLING FOR RIFLE OR CROSSBOW

CROSS REFERENCE TO RELATED APPLICATIONS

The present application claims the priority of U.S. Ser. No. 62/876,971 filed Jul. 22, 2019.

FIELD OF THE INVENTION

The present invention discloses an adjustable chest support sling for quick and substantially sound-less release of an elongated firearm or crossbow, this utilized by such as by a hunter when stalking prey. Unique aspects include the provision of a butt stock end supporting pocket in combination with a length position adjustable hook and loop or snap release strap for supporting a barrel location of the rifle or similar length support of a crossbow.

BACKGROUND OF THE INVENTION

The prior art is documented with examples of firearm or bow transport devices, including slings and other carrier options. Among these are U.S. Pat. No. 3,211,351 to Somple for one type of gun sling including a chest support sling with front and rear arcuate "U" shape stock clamps.

U.S. Pat. No. 4,121,743, to Burton and entitled a Bow Transport Holster, teaches a single clip with male and female mating interlock portions.

U.S. Pat. No. 4,768,689, to Davis and entitled Multi-Purpose Sling Apparatus, discloses a front or back supported sling for a barrel firearm or bow including opposite end configured hooks.

U.S. Pat. No. 5,246,154, to Adams and entitled Carrier for Archery Bow and Other Equipment, discloses an adjustable shoulder strap with padded protector and looped extending cord for single point engagement of a mid-point of a firearm or bow.

U.S. Pat. No. 5,564,610, to Barron and entitled Rifle Sling Support Apparatus, teaches a sling including a rear belt securement clip and strap (see FIG. 1).

U.S. Pat. No. 6,749,099, to Danielson and entitled Firearm Rest Having Shock Absorbing Line, teaches a belt supported gun support line for looping around a base end of the stock, with the user supporting the extending barrel.

U.S. Pat. No. 7,959,046, to Burnsed, Jr., and entitled a Method and Apparatus for Multiple Position Sling for a Firearm (also US 2006/0011677), teaches an adjustable strap harness with two point engagement clips for intermediate and end engagement of a front supported firearm. This can include straps and connectors for any of one, two or three point mode connection.

U.S. Pat. No. 10,281,234, to Burnsed, Jr. and entitled Sling Attachment Device, is similar to U.S. Pat. No. 7,959,046, except with elongated and flexible end connectors in place of the standard clips in the earlier reference.

US 2009/0321484, to Schweikert and entitled Rifle with Sling and Clip, discloses an over the shoulder rear support sling and clip arrangement with two point connection including a flexible bungee cord that connects a clip to a belt hook location.

Finally, US 2017/0102207, to Janzen and entitled a Rifle Retainer, teaches a rifle sling with first and second cross directed straps and including a foldable stock anchorage member 110 in combination with an upper loop connector.

SUMMARY OF THE PRESENT INVENTION

The present invention discloses a chest support sling for hands free transport along with allowing for quick release of an elongated firearm or crossbow. In each instance, the sling includes a circumference adjustable main strap adapted to being supported upon a shoulder of a wearer and which is further adapted to support a pocket arranged at a side waist location of the wearer for receiving a butt end of the firearm or crossbow. The main strap is divided into first and second subset lengths and is length adjustable via an intermediate located buckle secure to an end of the second subset length and through which is passed a tail of the first subset length, a buckle keeper or other loop being provided to hold the tail in place against the strap so that it doesn't flap around on the firearm or crossbow during use.

A secondary support strap extends from the main strap and is adapted to encircle and engage an extended location of the firearm or crossbow in order to maintain hands-free support when carried by the wearer. The secondary strap includes first and second extending straps which can exhibit any of opposing snaps or hook and loop inter-engaging portions formed thereon for encircling and maintaining in place around the extended location of the firearm or crossbow.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
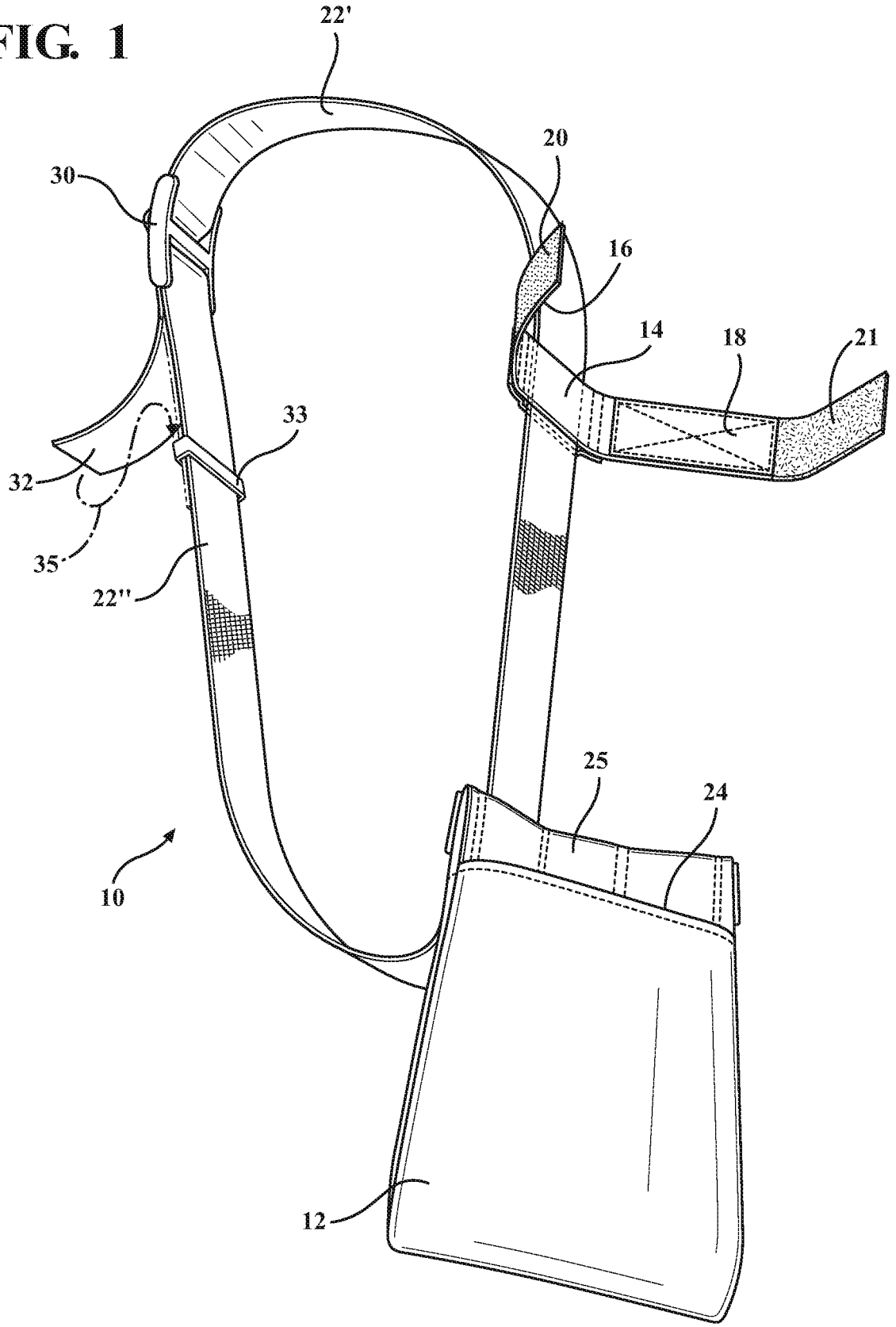
FIG. 1 is a perspective view of an adjustable chest support sling for hand free carry with fast release of an elongated firearm or crossbow, such as by a hunter when stalking prey, this including the provision of a butt stock end supporting pocket in combination with a length position adjustable hook and loop or snap release strap for supporting a barrel location of the rifle or similar length support of a crossbow.

With reference to FIGS. 1-6 and 12 the present invention discloses an adjustable chest support sling, see as generally depicted at 10 in FIG. 1, for accomplishing easy hands free support of a long firearm or crossbow and which provides each of quick and quiet release, such as by a hunter when stalking prey. With succeeding reference to FIGS. 7-11, a series of additional views are presented of a crossbow supporting variant, generally at 34, will be further described in reference to an additional and non-limiting application of the present invention.

As will be further described, unique aspects include the provision of a butt stock end supporting pocket 12, this in combination with a length position adjustable Velcro or other hook and look style fastener or snap release strap 14 for supporting a barrel location of the rifle (see as further shown at 2 in FIGS. 3-6) or, alternatively, a similar length support of a crossbow (further reference being had to the alternate sling variant of FIGS. 7-11 with crossbow 6 in FIGS. 8-11).

Figure 12:
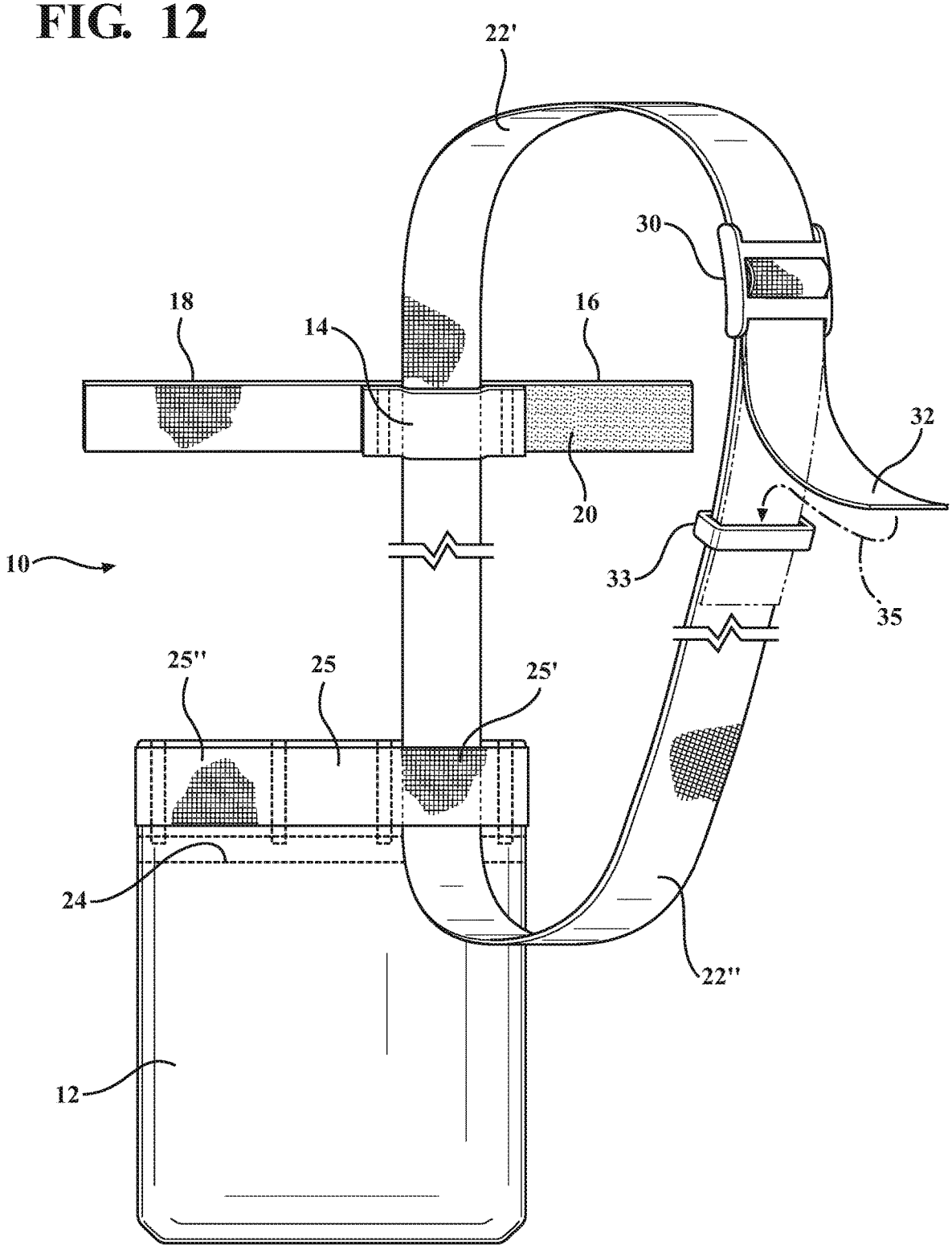
FIG. 12 is a rotated and reverse facing view of the adjustable chest support sling such as depicted in FIG. 1 and again depicting the butt stock end supporting pocket in combination with length position adjustable Velcro or other hook and loop style fasteners or other snap release strap for supporting a barrel location of the rifle or similar length support of a crossbow.

Referring initially to FIGS. 1 and 12, respective front and rotated rear perspective views are again depicted of the adjustable chest support sling 10 for quick and quiet release of an elongated firearm or crossbow. As previously indicated, this includes the provision of the butt stock end supporting pocket 12 in combination with a length position adjustable Velcro, hook and loop style fastener, or other snap release strap 14. The adjustable strap 14 further includes first 16 and second 18 extending portions, each further exhibiting an opposing array of hook and loop fastener portions (such as further depicted at 20 for strap portion 16 and at 21 for strap portion 18).

A main loop extending and upper body supporting strap is generally shown and, in a first configuration, is provided as a single extending length which can include first 22' and second 22" inter adjustable subset portions and which connect to the buttstock receiving pocket at an intermediate looped and inserting location. As shown, the holster pocket 12 has a straight upper defining pocket rim edge 24 along its front edge. As further best shown in FIG. 2, an upper rear surface attaching reinforcing portion is shown at 25 and which defines individual multi-loop receiving pockets or locations (three of which are shown) for alternately receiving the intermediate looped location of the main strap 22.

In this fashion, and by utilizing either of the right located looped receiving pocket (shown in FIGS. 2 and 12 at 25') or the left located looped receiving portion (further at 25") the strap can be optimized for either of right or left handed use as well as for optimizing the support angle for the rifle when the strap is supported upon the user and the buttstock received within the supporting pocket 12. It is also envisioned that the main strap subset portions 22'/22" can be provided as separate interconnected lengths which are fixedly secured to any reconfiguration of the holster pocket 12.

Figure 2:
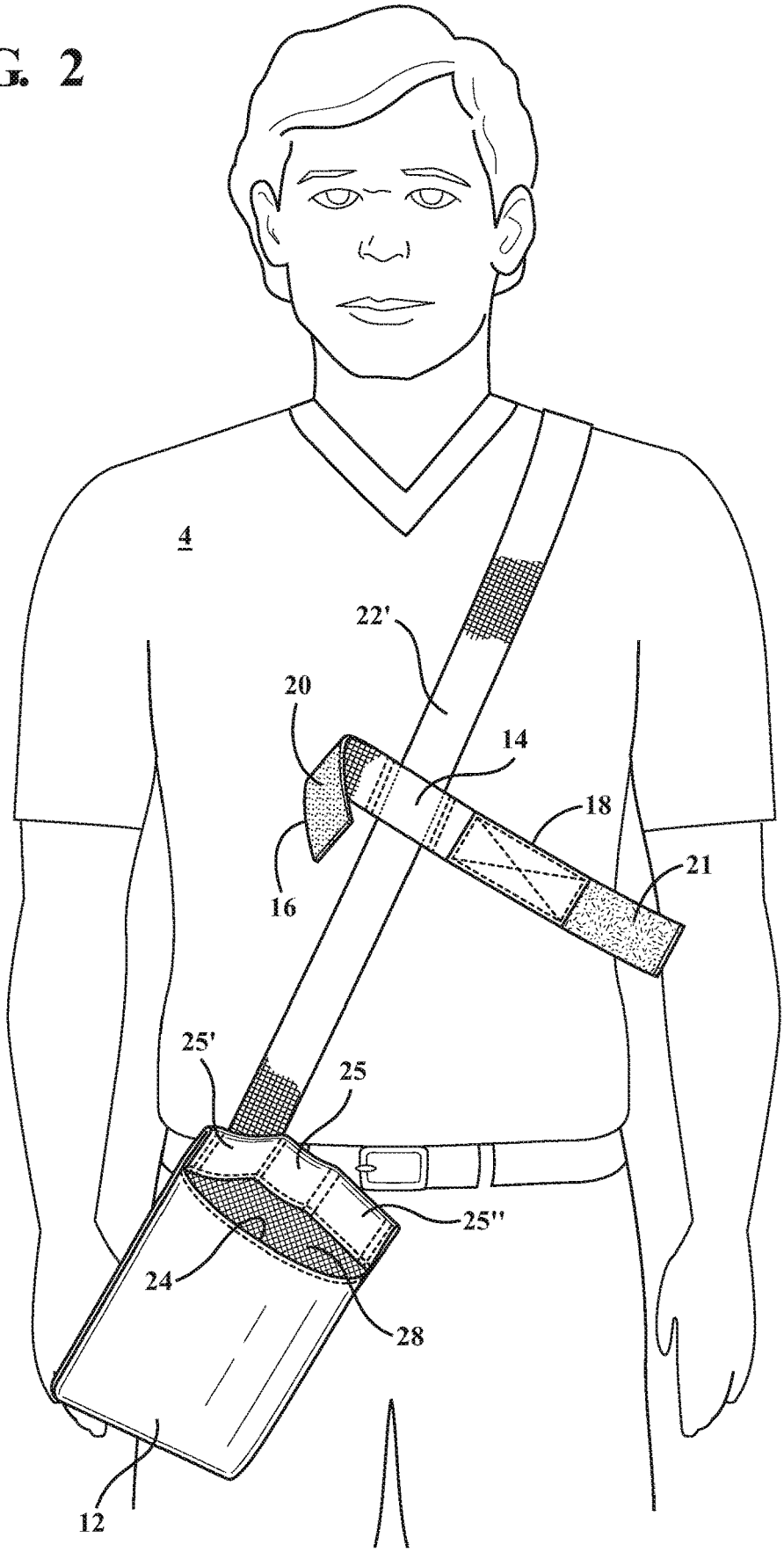
FIG. 2 is an environmental view of the adjustable chest support sling worn by an individual.

FIG. 2 is an environmental view of the adjustable chest support sling adapted to being worn by an individual 4, prior to engagement of the rifle 2 or crossbow 6, and so that the main strap 22 extends over the wearers shoulder and the end supporting pocket 12 is arranged at a side waist location, such as which can be approximate in height to a wearer's belt or upper pant line. The sling is further illustrated in FIG. 2 prior to supporting the elongated object (such as again represented by the firearm 2). As further shown the butt or shoulder stock receiving pocket 12 can be constructed of a vinyl or leather or other faux leather material which is double stitched to support the weight of the rifle, crossbow or other object and can include an inner felt lining (representatively shown at 28).

Figure 6:
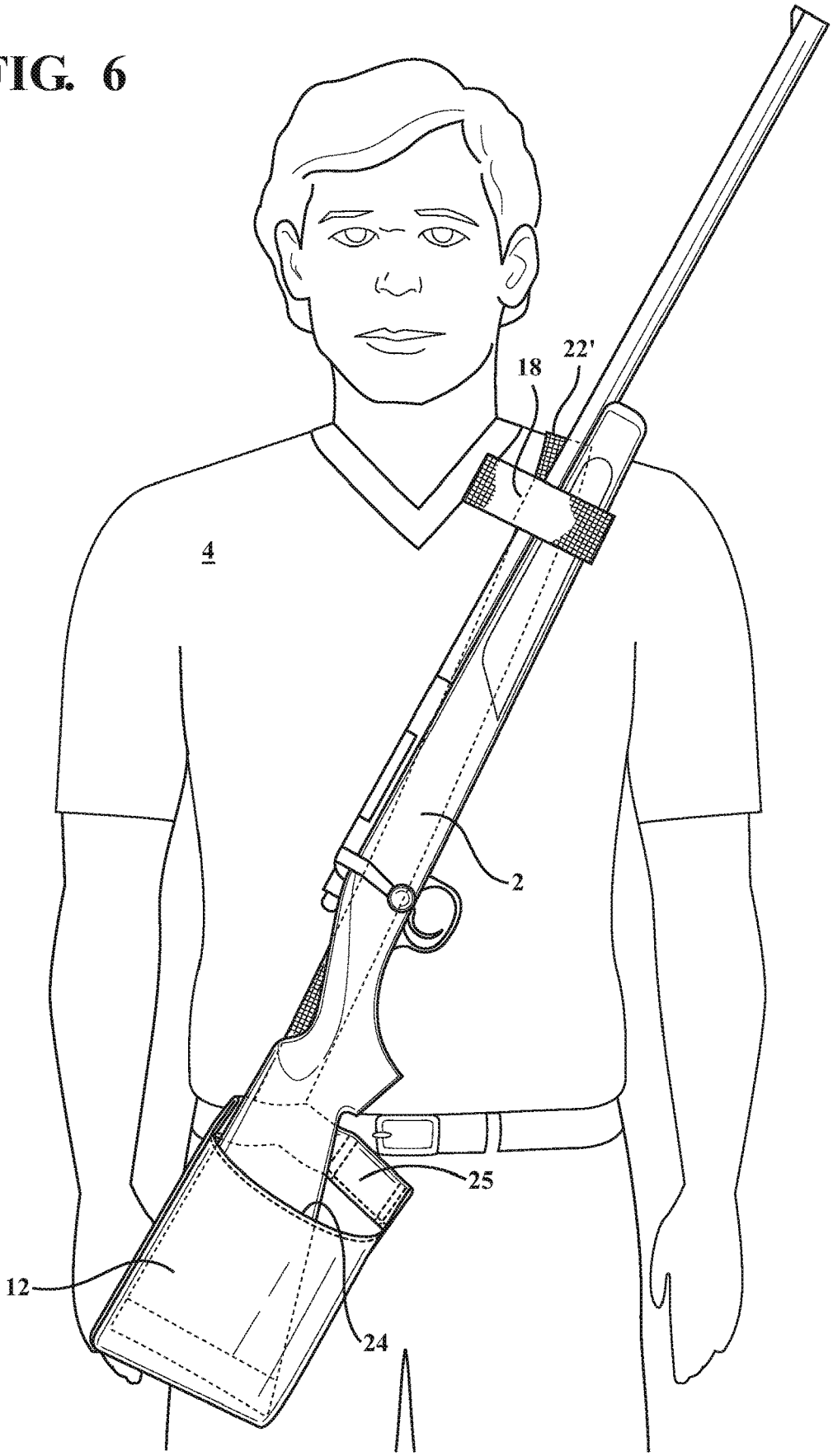
FIG. 6 illustrates the firearm in a hands free supported position by the adjustable chest strap with the stock butt end support.

The main looped strap subset portions 22' and 22" can further be interconnected and length adjustable via a buckle portion 30 as shown in FIGS. 1 and 12 and which, when supported upon the user, is located over the user's back, with a tail end 32 of the first main strap portion 22' extends through the buckle portion 30, which is in turn secured the second main strap portion 22" for establishing a desired overall and adjustable looped length which properly supports the rifle or firearm in the manner depicted in FIG. 6. A buckle keeper loop 33 is also depicted in each of FIGS. 1 and 12 for receiving and holding the tail extending portion 32 (see insertion arrow 35) in place against the main strap so that it doesn't flap around on both the firearm and cross bow sling. The main strap (subset portions 22', 22") and adjustable strap 14 can further be constructed of a durable and waterproof material not limited to a vinyl coated polyester or the like.

Figure 3:
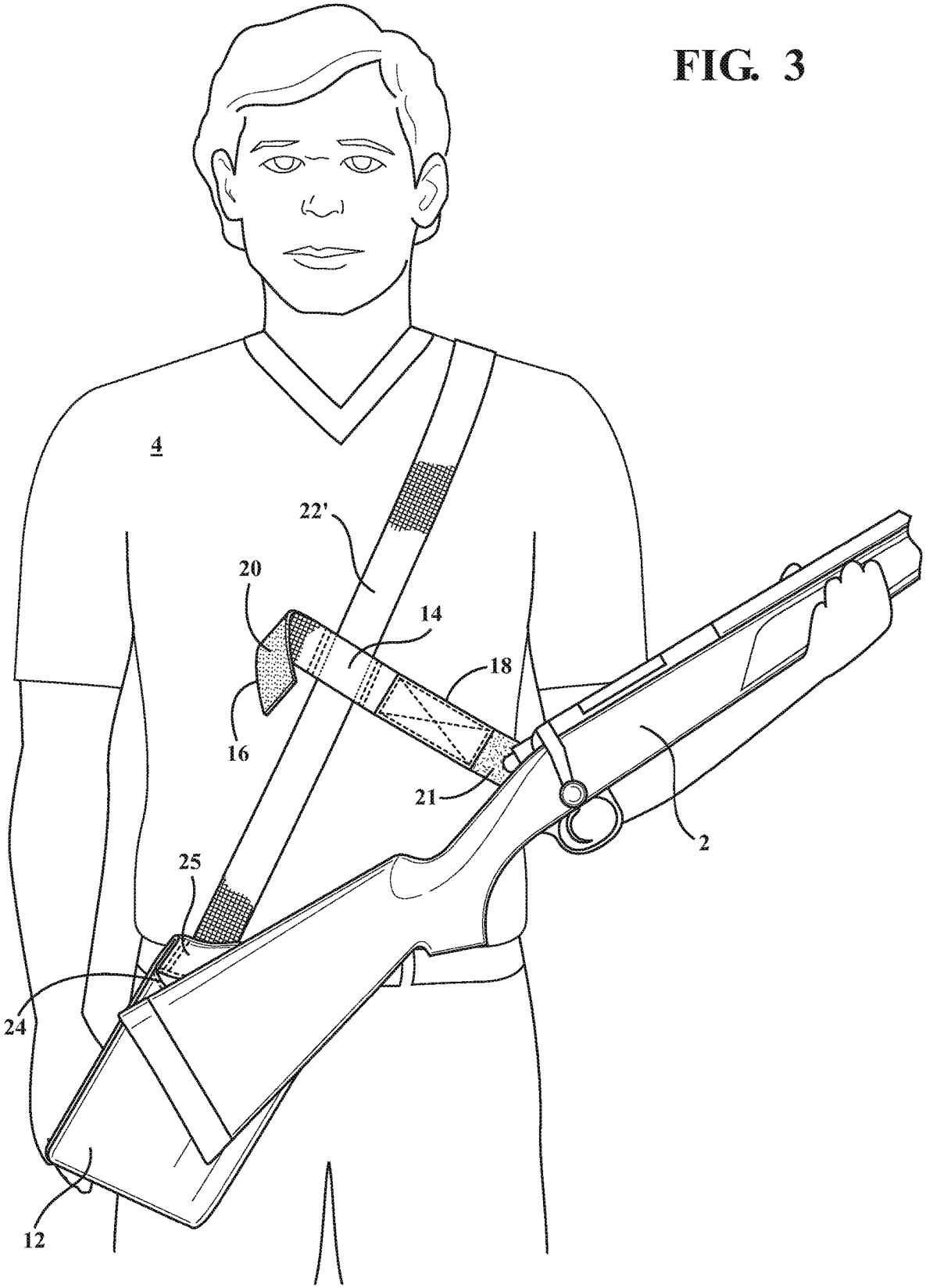
FIG. 3 is a succeeding view to FIG. 2 illustrating the quick retrieval feature of a firearm relative to the chest supported sling.
Figure 4:
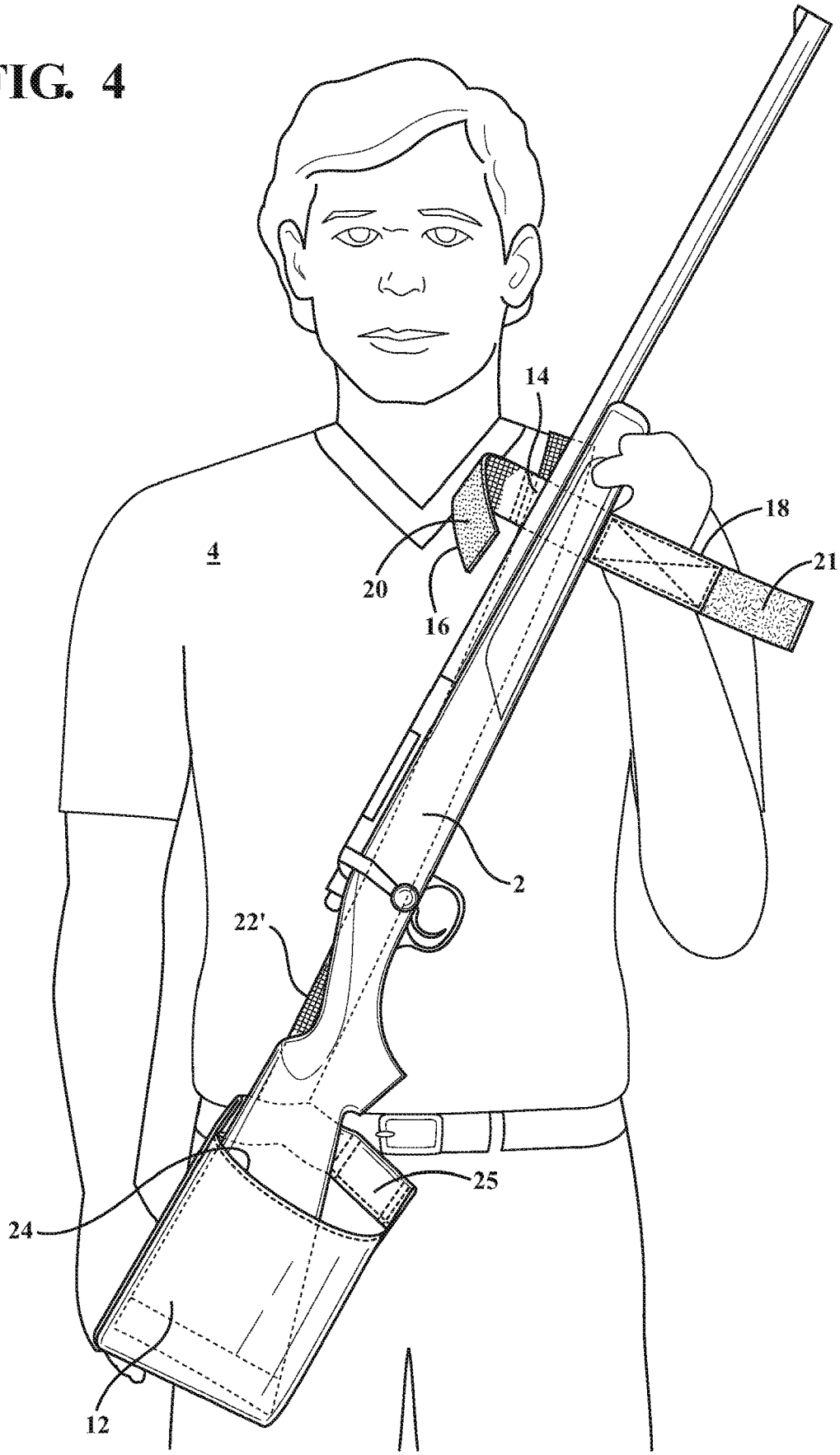
FIG. 4 is a further succeeding view of the firearm in a substantially butt end supported configuration in combination with an intermediate attachment position for the adjustable barrel strap.

FIG. 3 is a succeeding view to FIG. 2 and illustrating the quick retrieval feature of a firearm relative to the chest supported sling. FIG. 4 is a further succeeding view of the firearm in a substantially butt end supported and intermediate secured configuration in combination with an intermediate attachment position for the adjustable barrel strap, such that that middle connected portion 14 is optionally configured so as to be slidable along the main strap 22 and, once positioned at the desired location relative to the rifle barrel (or crossbow body) allowing the respective hook and loop portions of the strap portions 16/18 to be engaged. The present invention contemplates the adjustable strap 14 being adjustable to any location along the main strap portion 12' and depending upon the desired location for securing the barrel of the firearm or crossbow body.

Figure 5:
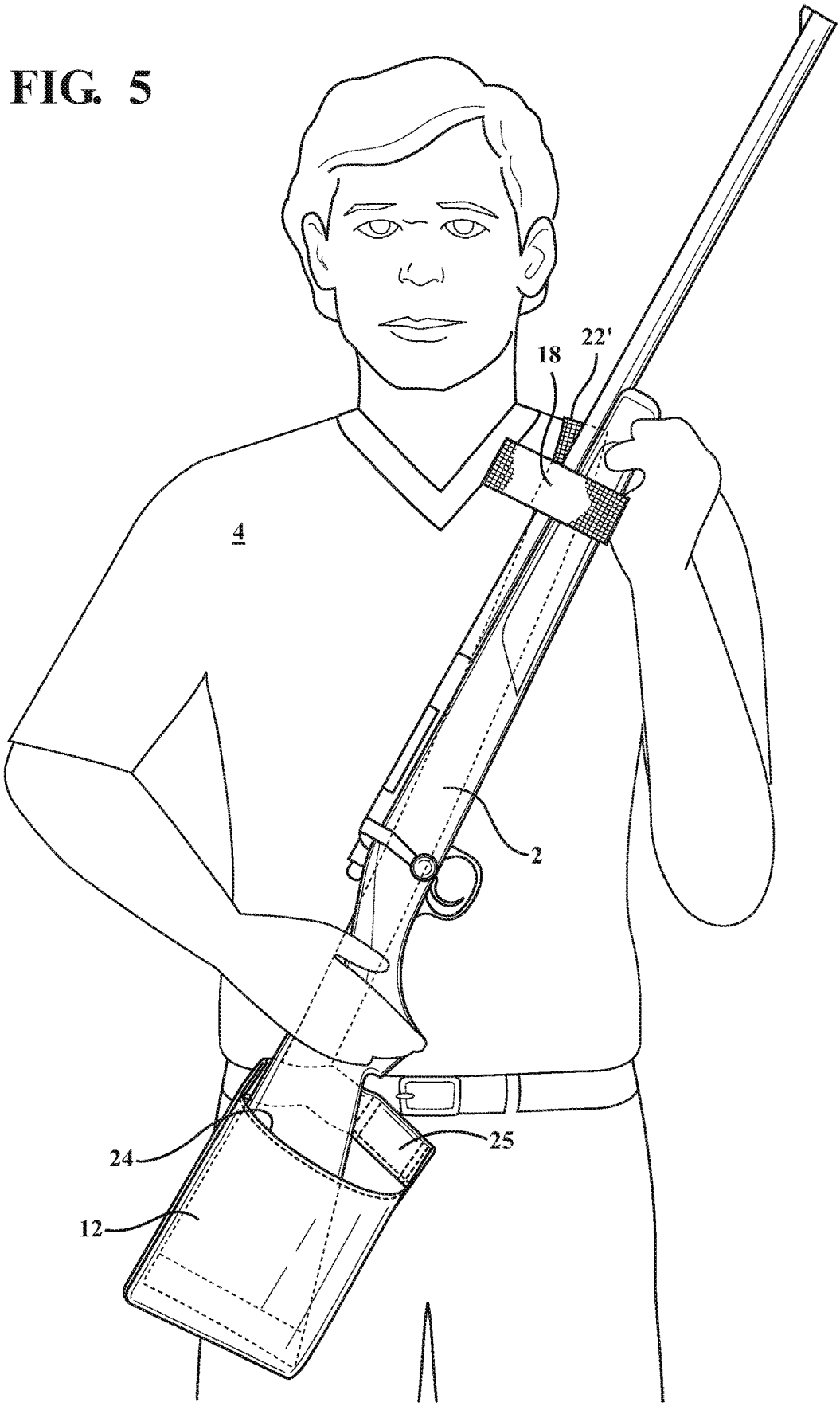
FIG. 5 succeeds FIG. 4 and illustrates the completed attachment of the adjustable strap to the firearm barrel.

FIG. 5 succeeds FIG. 4 and illustrates the completed attachment of the adjustable strap to the firearm barrel. FIG. 6 illustrates the firearm in the strap engaged and supported position of FIG. 6 such that it is hands free supported by the combination of the adjustable chest strap with the stock butt end.

Figure 7:
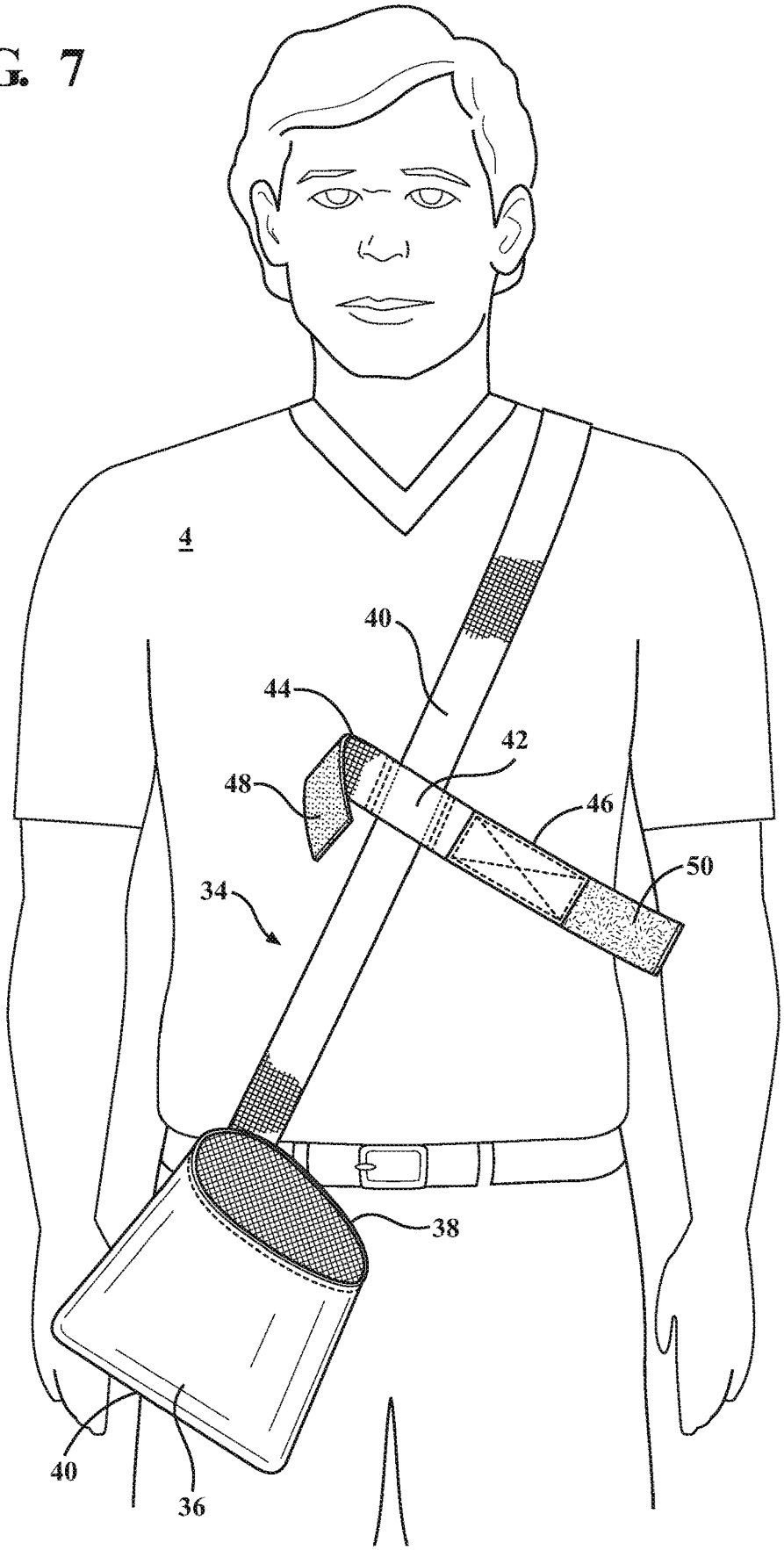
FIG. 7 is a perspective illustration of a crossbow supporting variant of the adjustable sling according to the present invention.
Figure 10:
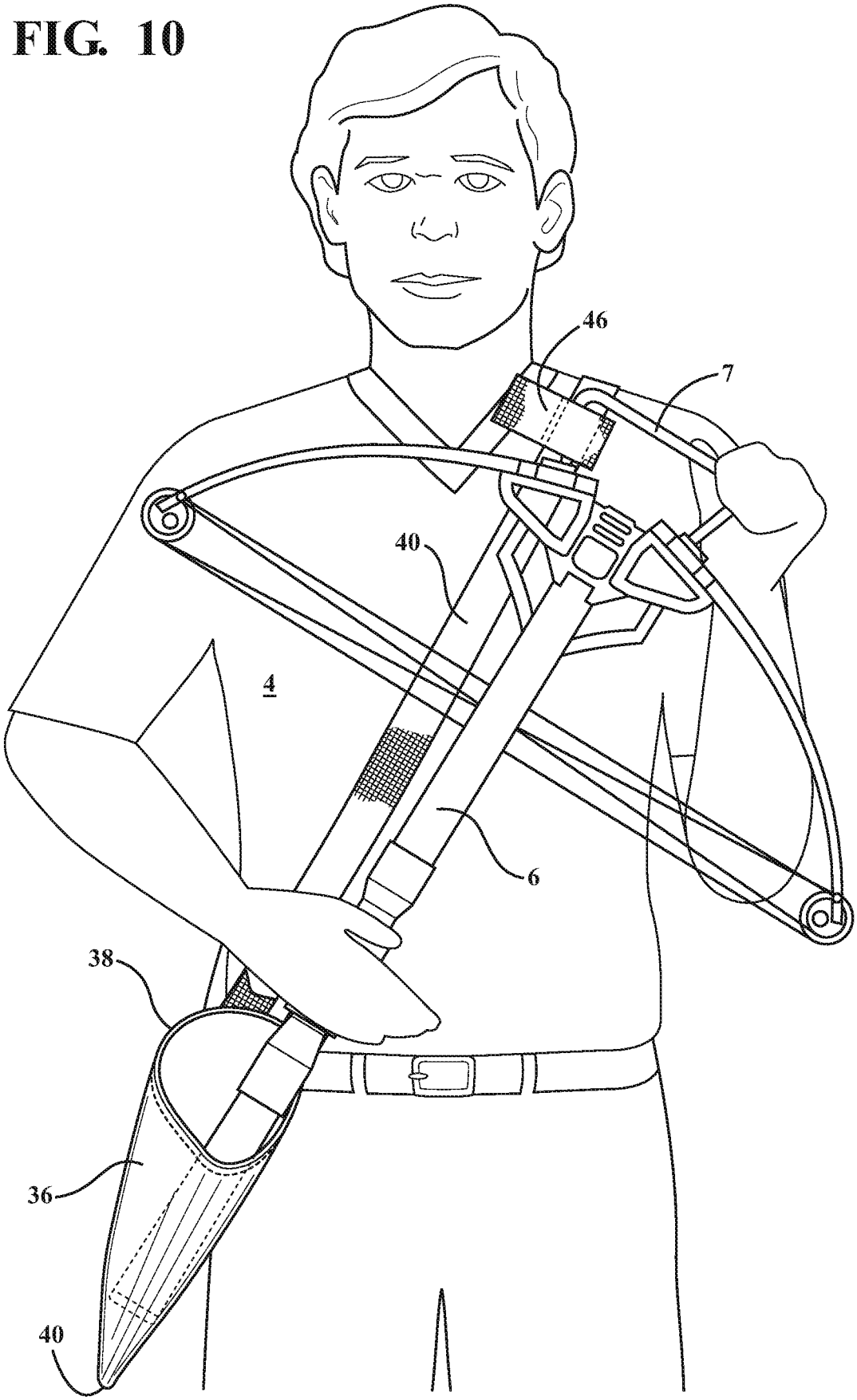
FIG. 10 illustrates a fully engaged configuration of the crossbow supported by the sling of FIG. 7.
Figure 11:
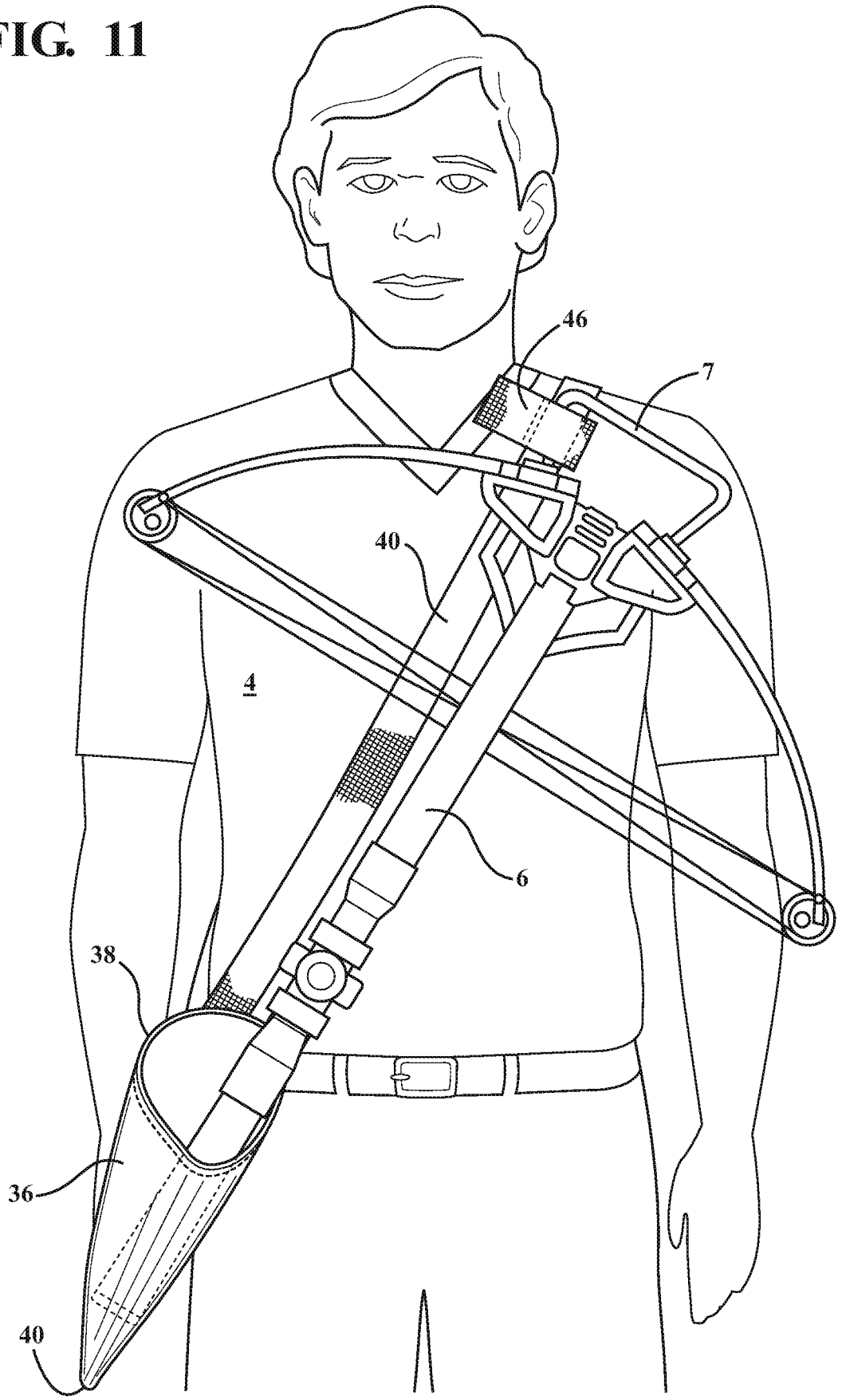
FIG. 11 is a succeeding view to FIG. 10 and showing a hands free configuration of the crossbow supporting sling.

With reference now FIG. 7, a perspective illustration is generally shown again at 34 of a crossbow supporting variant of the adjustable sling according to the present invention. As will be further described, the crossbow variant largely replicates the structural aspects of the rifle supporting variant 10 with the exception of a reconfiguration of a buttstock receiving pocket, depicted at 36, being reconfigured with a generally oval shaped upper rim edge including a raised rear extending edge portion 38, the pocket further including a narrowed and linear bottom extending edge 40 for seating the buttstock of the cross bow 6 as best shown in FIGS. 10-11.

A main strap 40 is provided which, similar to that shown in the variant of FIG. 1, can include subset portions which extend in a looped fashion and adjustably interconnect at opposite ends, such as via a buckle similar to that previously shown at 30 and so that the main strap 40 can extend through one or more looped receiving locations, such as again which can be associated with the rear raised edge 38 of the receiving pocket 36 and again adaptable for either right or left handed use. The strap can again be alternatively provided in two pieces separately and fixedly connected to the receiving pocket 36.

Similar to the first variant 10, the crossbow supporting sling 36 again includes an adjustable strap having a central connecting portion 42 (such as which can be length adjustable along the main looped strap 40) and in turn further including first 44 and second 46 extending portions, each further exhibiting an opposing array of hook and loop fastener portions (such as further depicted at 48 for strap portion 44 and at 50 for strap portion 46). As further previously described, the central interconnecting portion 42 of the secondary strap can include a looped interior for slidably adjusting along the main strap 40. Alternative embodiments again can also envision the intermediate portion 42 being fixed at a given location to the main strap 40.

Figure 8:
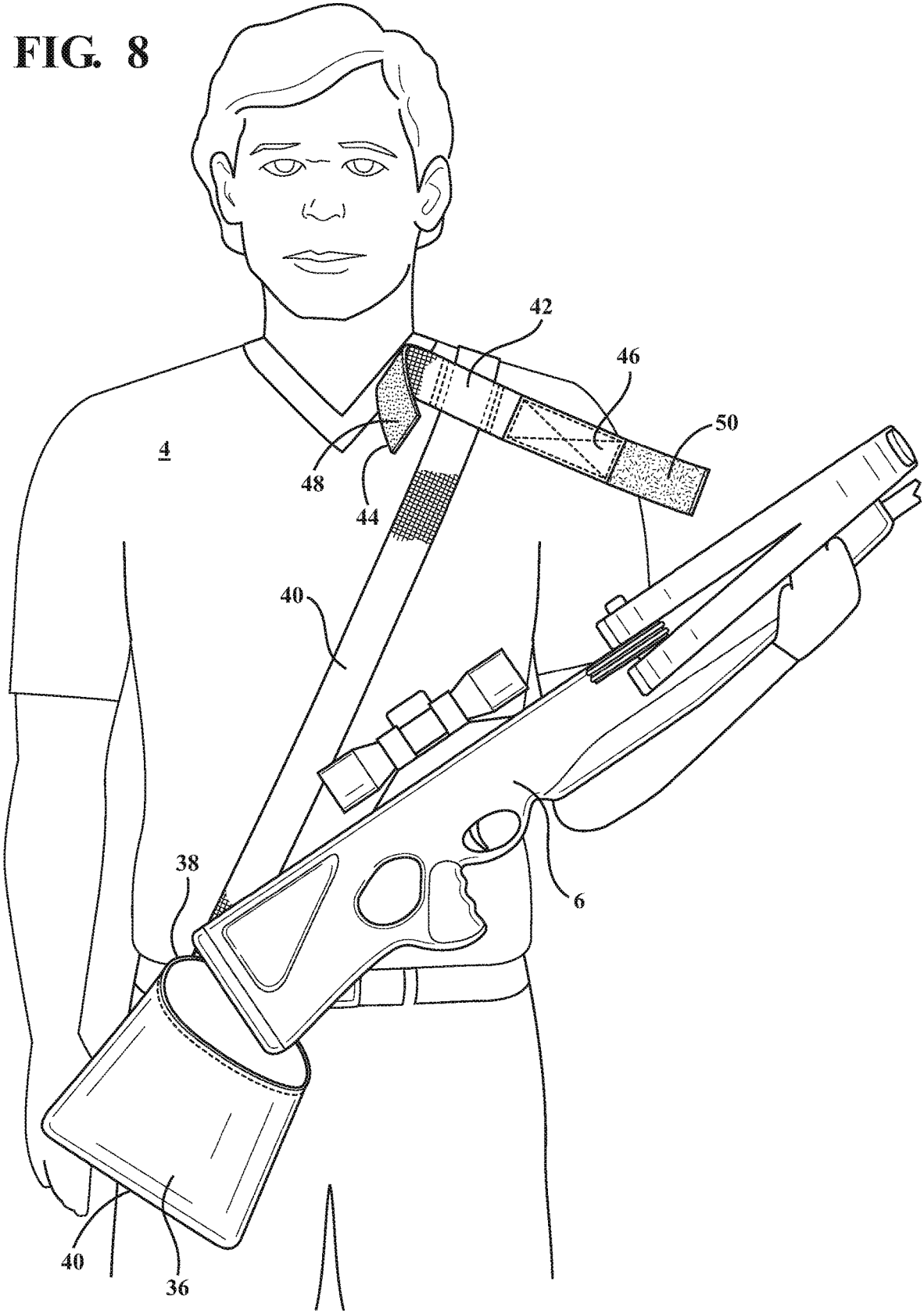
FIG. 8 is a succeeding illustration to FIG. 7 and showing the crossbow in an initially installing configuration in which the bow stock is inserted within the end supporting pocket.
Figure 9:
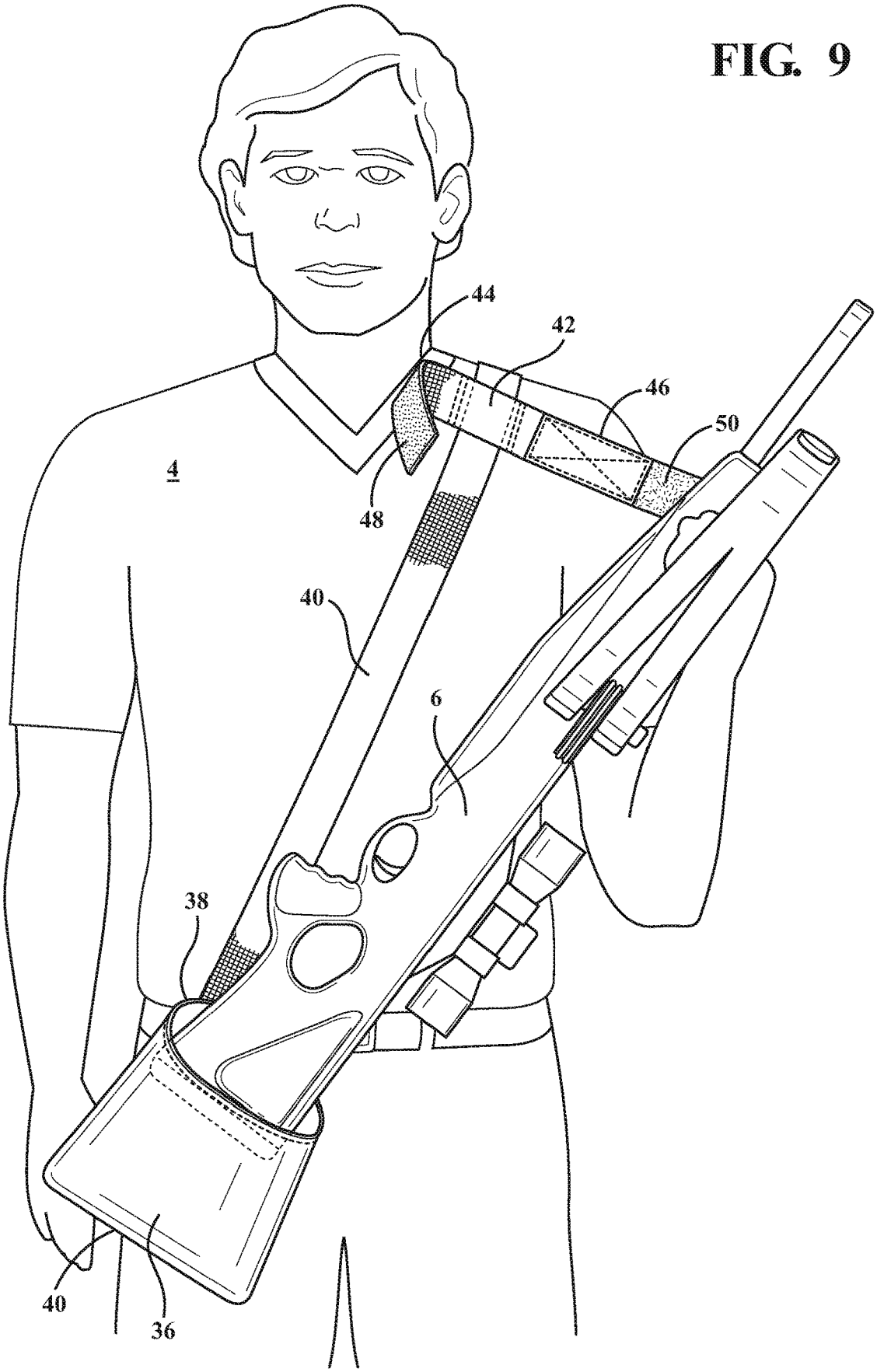
FIG. 9 is a further succeeding illustration in which the crossbow sling variant of FIG. 7 prior to engagement of the secondary strap.

FIG. 8 is a succeeding illustration to FIG. 7 and showing the crossbow 6 in an initially installing configuration in which the bow stock is inserted within the end supporting pocket, with FIG. 9 providing a further succeeding illustration in which the crossbow sling variant of FIG. 7 and depicting the bow in a further semi-installed position. FIG. 10 illustrates a fully engaged configuration of the crossbow 6 supported by the sling 34 of FIG. 7 and in which adjustable strap portions are secured directly to the crossbow cocking stirrup (see at 7) and FIG. 11 is a succeeding view to FIG. 10 and showing a hands free configuration of the crossbow supporting sling.

Advantages of the present designs of FIGS. 1-6 & 12 and FIGS. 7-11 include the ability to adjust to fit all types of rifles as well as elongated crossbows, and provided the butt stock pocket 12 or 36 to be adequately dimensioned to comfortably receive the inserted stock end of the firearm. The secure two point connection provided by the strap design provides for each of chest front mounting support as well as quick engagement and release, such as during hunting in which the individual in particular may be stalking prey.

The ability to front chest support the rifle or crossbow in the manner depicted also enable the weapon to be safely supported at all times, including in instances where the individual is either transporting the gun/crossbow or releasing the barrel of either style of weapon while also wearing a backpack and/or climbing gear. Beyond length adjustability, the sling can be further configured to provide either of left or right handed support. Beyond the hook and loop fasteners or similar portions (sold under the commercial name Velcro®), other durable snap release options can be substituted, such as which can also provide for quick release of the barrel securing strap portions 16/18 or 44/46 during hunting/stalking, clay target shooting or the like.

Having described my invention, other and additional preferred embodiments will become apparent to those skilled in the art to which it pertains, and without deviating from the scope of the appended claims. The detailed description and drawings are further understood to be supportive of the disclosure, the scope of which being defined by the claims. While some of the best modes and other embodiments for carrying out the claimed teachings have been described in detail, various alternative designs and embodiments exist for practicing the disclosure defined in the appended claims.

The invention claimed is:

1. A chest support sling for hands free transport with quick release of an elongated supported firearm or crossbow, said sling comprising:

a main strap adapted to being supported over a shoulder of a wearer and extending in a looped fashion relative to a pocket further adapted to be arranged to a side waist location of the wearer, said pocket further adapted to receive a butt end of the firearm or crossbow;

said pocket further including a straight upper defining pocket rim edge along its front edge, an upper rear surface attaching reinforcing portion defining individual multi-loop receiving pockets or locations for alternately receiving the intermediate looped location of the main strap for adapting to either right or left handed support; and a secondary support strap extending from said main strap and adapted to engage an extended location of the firearm or crossbow to maintain hands-free support when carried by the wearer.

2. The invention as described in claim 1, further comprising said secondary strap being an adjustable strap including first and second extending strap portions, each having inter-engaging portions formed thereon.

3. The invention as described in claim 2, said inter-engaging portions further comprising hook and loop portions.

4. The invention as described in claim 2, said secondary strap further comprising a central looped portion supporting said strap portions, said central looped portion slidably repositioning along said main strap.

5. The invention as described in claim 1, further comprising a buckle portion secured to an end of said main strap, an opposite end of said main strap extending through said buckle portion and defining a tail extending portion, a buckle keeper holding said tail end portion against said main strap.

6. The invention as described in claim 5, further comprising said tail extending portion being adjustable through said buckle portion to vary a diameter of said main strap.

7. The invention as described in claim 1, said main strap and adjustable secondary strap further comprising a durable and waterproof material not limited to a vinyl coated polyester.

8. A chest support sling for hands free transport with quick release of an elongated supported firearm or crossbow, said sling comprising:

a main strap adapted to being supported over a shoulder of a wearer and extending in a looped fashion relative to a pocket further adapted to be arranged to a side waist location of the wearer, said pocket further adapted to receive a butt end of the firearm or crossbow;

said pocket further including an oval shaped upper rim edge including a raised rear extending edge portion, said pocket further including a narrowed and linear bottom extending edge for seating the buttstock of the cross bow; and a secondary support strap extending from said main strap and adapted to engage an extended location of the firearm or crossbow to maintain hands-free support when carried by the wearer.

9. The invention as described in claim 8, further comprising said secondary strap being an adjustable strap including first and second extending strap portions, each having inter-engaging portions formed thereon.

10. The invention as described in claim 9, said interengaging portions further comprising hook and loop portions.

11. The invention as described in claim 9, said secondary strap further comprising a central looped portion supporting said strap portions, said central looped portion slidably repositioning along said main strap.

12. The invention as described in claim 8, further comprising a buckle portion secured to an end of said main strap, an opposite end of said main strap extending through said buckle portion and defining a tail extending portion, a buckle keeper holding said tail end portion against said main strap.

13. The invention as described in claim 12, further comprising said tail extending portion being adjustable through said buckle portion to vary a diameter of said main strap.

14. The invention as described in claim 8, said main strap and adjustable secondary strap further comprising a durable and waterproof material not limited to a vinyl coated polyester.

* * * * *